US008443499B2

(12) United States Patent
Clever et al.

(10) Patent No.: US 8,443,499 B2
(45) Date of Patent: May 21, 2013

(54) CONCENTRIC CAMSHAFT AND METHOD OF ASSEMBLY

(75) Inventors: Glenn E. Clever, Washington, MI (US); Roy Glenn Kaywood, Jackson, MI (US); Ronald Hendrick, Parma, MI (US)

(73) Assignee: GM Global Technology Operations LLC

( * ) Notice: Subject to any disclaimer, the term of this patent is extended or adjusted under 35 U.S.C. 154(b) by 659 days.

(21) Appl. No.: 12/396,796

(22) Filed: Mar. 3, 2009

(65) Prior Publication Data

US 2010/0223771 A1 Sep. 9, 2010

(51) Int. Cl.

| | |
|---|---|
| ***B23P 19/04*** | (2006.01) |
| ***B23P 19/02*** | (2006.01) |
| ***B23P 11/00*** | (2006.01) |
| ***B21D 53/84*** | (2006.01) |
| ***B21K 1/12*** | (2006.01) |
| ***F16H 53/00*** | (2006.01) |
| ***F01L 1/04*** | (2006.01) |

(52) U.S. Cl.
USPC ..... 29/234; 29/888.1; 29/432; 123/90.6; 74/567

(58) Field of Classification Search
USPC ..... 29/888.1, 234, 432; 123/90.6; 74/567
See application file for complete search history.

(56) References Cited

U.S. PATENT DOCUMENTS

| | | | | |
|---|---|---|---|---|
| 4,575,913 | A * | 3/1986 | Sugiuchi et al. | 29/432 |
| 4,597,365 | A * | 7/1986 | Madaffer | 123/90.6 |
| 4,662,618 | A * | 5/1987 | Willis | 269/43 |
| 4,993,282 | A * | 2/1991 | Swars | 74/567 |
| 5,205,187 | A * | 4/1993 | Ebbinghaus | 74/567 |
| 5,259,268 | A * | 11/1993 | Ebbinghaus et al. | 74/567 |
| 5,265,854 | A * | 11/1993 | Whiteford | 269/3 |
| 5,469,759 | A * | 11/1995 | Orsini, Jr. | 74/567 |
| 5,526,715 | A * | 6/1996 | Swann et al. | 74/822 |
| 5,853,168 | A * | 12/1998 | Drake | 269/6 |
| 5,992,017 | A * | 11/1999 | Grafchev et al. | 29/888.1 |
| 6,438,854 | B1 * | 8/2002 | Kott, Jr. | 33/286 |
| 6,568,667 | B1 * | 5/2003 | Hall | 269/6 |
| 6,615,468 | B2 * | 9/2003 | Bloecker et al. | 29/281.1 |
| 6,752,059 | B1 * | 6/2004 | Posont | 83/745 |
| 6,802,988 | B1 * | 10/2004 | Wenderoth et al. | 252/73 |
| 7,086,312 | B1 * | 8/2006 | Tortolani | 81/355 |
| 7,172,183 | B1 * | 2/2007 | Yang | 269/6 |
| 7,546,996 | B2 * | 6/2009 | Somji | 248/451 |
| 7,604,224 | B2 * | 10/2009 | Rowlay et al. | 269/6 |
| 7,631,434 | B1 * | 12/2009 | Carter, Jr. | 33/293 |
| 7,651,078 | B2 * | 1/2010 | Geier et al. | 269/6 |
| 7,735,813 | B2 * | 6/2010 | Geier et al. | 269/6 |

(Continued)

FOREIGN PATENT DOCUMENTS

CN 101142378 A 3/2008

*Primary Examiner* — Lee D Wilson

*Assistant Examiner* — Alvin Grant

(74) *Attorney, Agent, or Firm* — Harness, Dickey & Pierce, P.L.C.

(57) ABSTRACT

A method of assembling a camshaft may include locating a first lobe member of the camshaft on a first shaft and inserting a locking pin into a first bore in the first lobe member and into a second bore in the first shaft. The locking pin may include a first recess extending into a first end thereof defining a first annular wall. A first retaining member may be forced into a first recess. The forcing may displace the annular wall in an outward radial direction and into a frictional engagement with the first bore.

20 Claims, 5 Drawing Sheets

U.S. PATENT DOCUMENTS 7,849,630 B2 * 12/2010 Carnevali ..... 43/21.2
7,849,829 B2 * 12/2010 Clever et al. ..... 123/90.6
7,866,293 B2 * 1/2011 Clever et al. ..... 123/90.6
7,958,859 B2 * 6/2011 Methley et al. ..... 123/90.6
7,966,983 B2 * 6/2011 Clever et al. ..... 123/90.6
8,225,762 B2 * 7/2012 Lancefield et al. ..... 123/90.17
2007/0138367 A1 * 6/2007 Somji ..... 248/447.2
2008/0179801 A1 * 7/2008 Geier et al. ..... 269/6
2008/0257104 A1 10/2008 Lancefield et al.
2010/0083498 A1 * 4/2010 Wakade et al. ..... 29/888.1

* cited by examiner

CONCENTRIC CAMSHAFT AND METHOD OF ASSEMBLY

FIELD

The present disclosure relates to engine camshaft assemblies.

BACKGROUND

This section provides background information related to the present disclosure which is not necessarily prior art.

Engines typically include a camshaft to actuate intake and exhaust valves. Some camshafts are concentric camshafts that provide for relative rotation between, for example, the intake and exhaust lobes. The intake lobes may be fixed to an outer shaft for rotation with the shaft and the exhaust lobes may be rotatably supported on the shaft. Alternatively, the exhaust lobes may be fixed to the outer shaft for rotation with the shaft and the intake lobes may be rotatably supported on the shaft. In any arrangement, the lobes that are rotatably supported on the outer shaft may be rotationally fixed to the inner shaft using a fastener. Insertion of these fasteners may apply a radial load to the camshaft during assembly.

SUMMARY

This section provides a general summary of the disclosure, and is not comprehensive of its full scope or all of its features.

A method of assembling a camshaft may include locating a first lobe member of the camshaft on a first shaft and inserting a locking pin into a first bore in the first lobe member and into a second bore in the first shaft. The locking pin may include a first recess extending into a first end thereof defining a first annular wall. A first retaining member may be forced into the first recess. The forcing may displace the annular wall in an outward radial direction and into a frictional engagement with the first bore.

The method may further include forcing a second retaining member into a second recess located in a second end of the locking pin generally opposite the first end. The first retaining member may be forced into the first recess simultaneously with the second retaining member being forced into the second recess.

The camshaft assembly may include a first shaft including a first radial bore, a first lobe member located on the first shaft and including a second radial bore aligned with the first radial bore, and a locking pin located within the first and second radial bores. The locking pin may include first and second longitudinal ends generally opposite one another. The first longitudinal end may include a first recess extending axially therein and a first retaining member located within the first recess. The first retaining member may bias an annular wall defined by the first recess in an outward radial direction into a frictional engagement with a first portion of the second radial bore.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
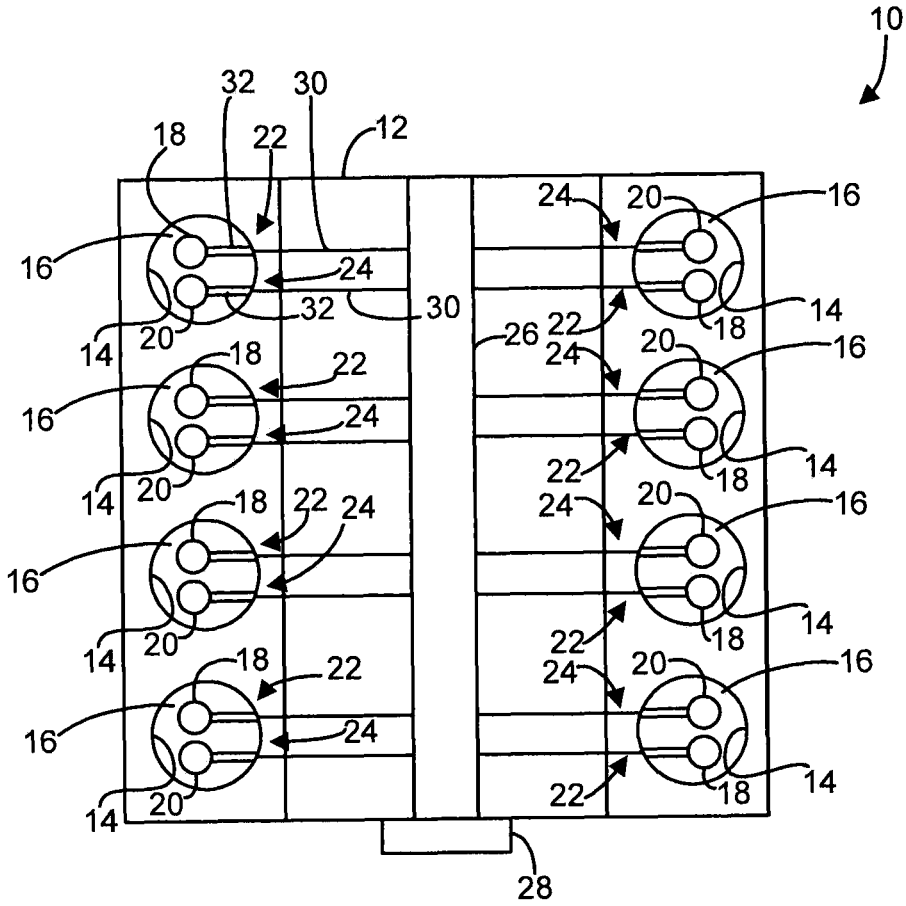
FIG. 1 is a schematic illustration of an engine assembly according to the present disclosure.
Figure 2:
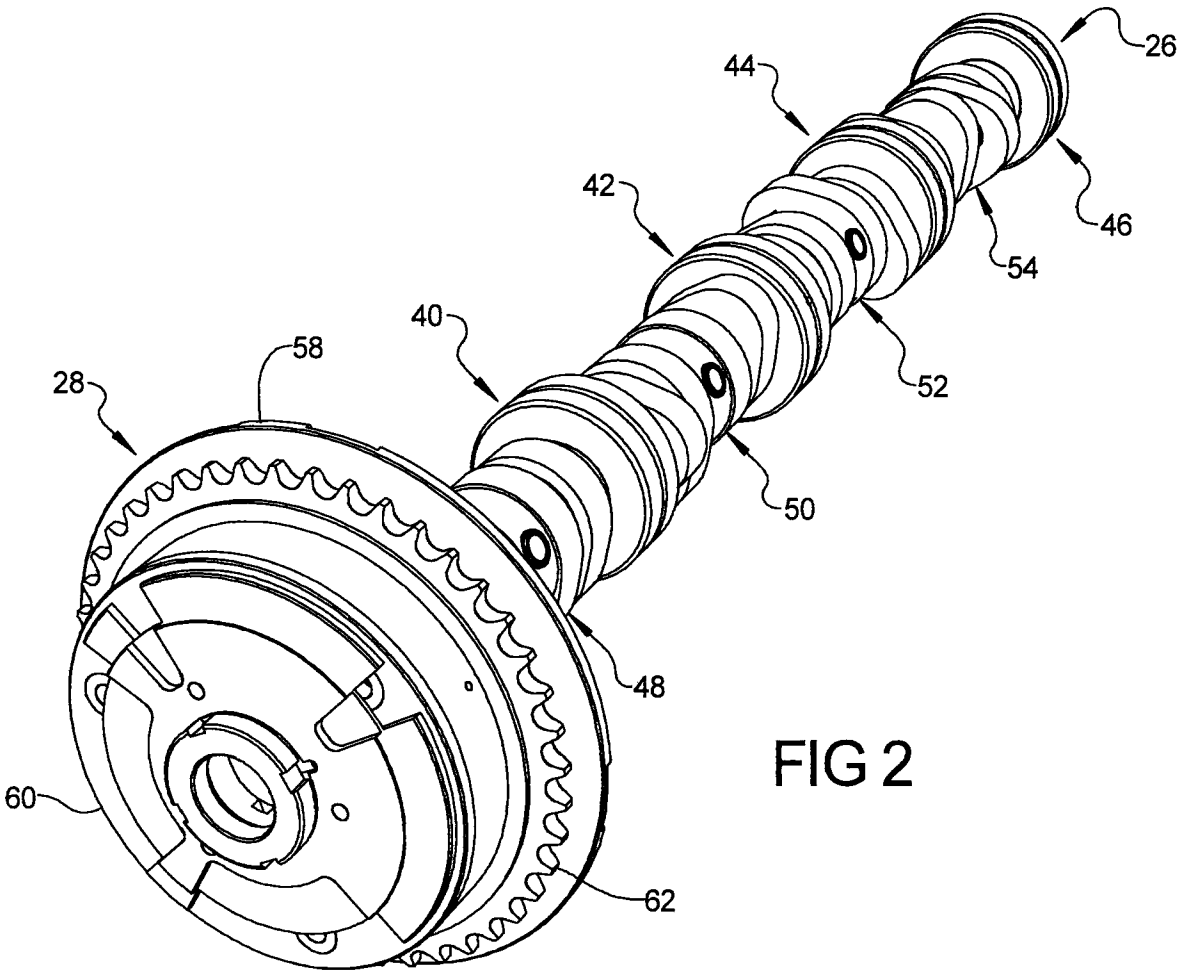
FIG. 2 is a perspective view of the camshaft and cam phaser of FIG. 1.
Figure 3:
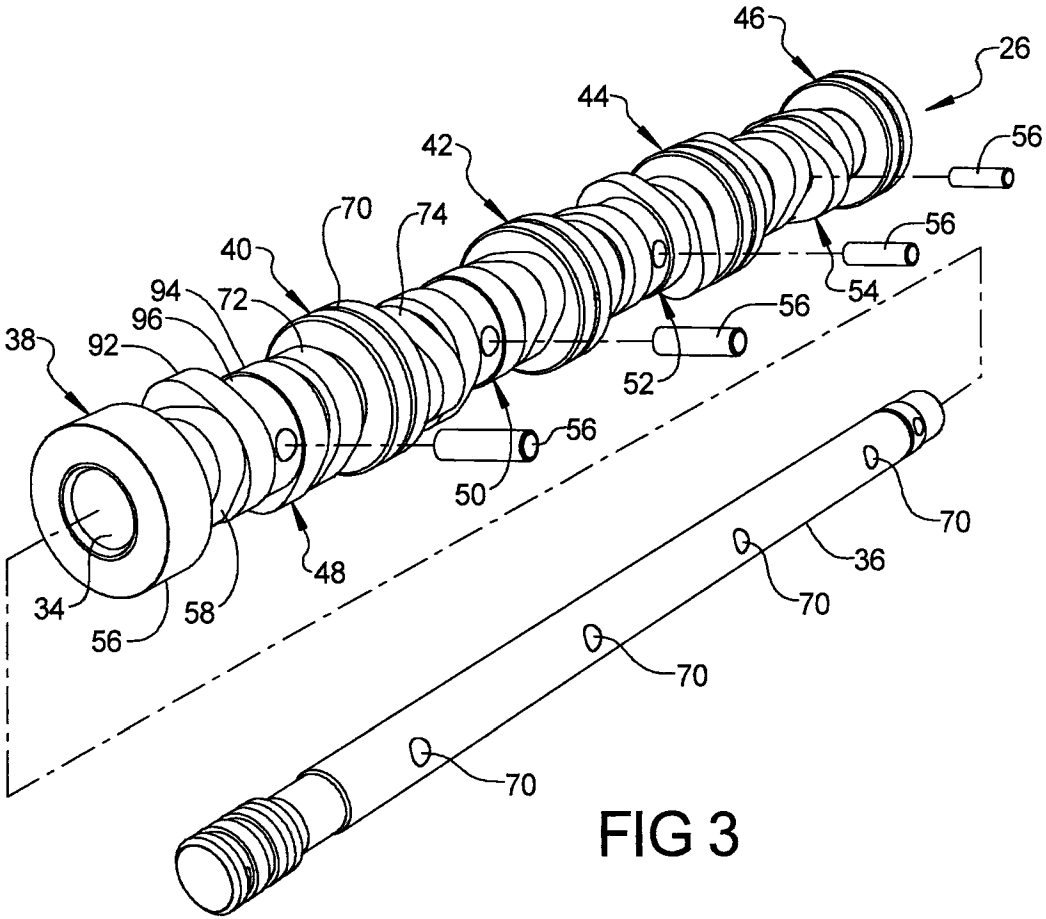
FIG. 3 is a perspective exploded view of the camshaft of FIG. 1.

Referring now to FIG. 1, an exemplary engine assembly 10 is schematically illustrated. The engine assembly 10 may include an engine 12 including a plurality of cylinders 14 having pistons 16 disposed therein. The engine 12 may further include an intake valve 18, an exhaust valve 20, and intake and exhaust valve lift mechanisms 22, 24 for each cylinder 14, as well as a camshaft 26 and a cam phaser 28.

The intake valve lift mechanism 22 may include a pushrod 30 and a rocker arm 32. The exhaust valve lift mechanism 24 may additionally include a pushrod 30 and a rocker arm 32. Pushrods 30 may be engaged with the camshaft 26 to actuate the rocker arms 32 and selectively open the intake and exhaust valves 18, 20. While the engine assembly 10 is illustrated as a pushrod engine, it is understood that the present disclosure is not limited to pushrod engines and may be applicable to a variety of other engine configurations as well, such as overhead cam engines.

With reference to FIGS. 2-5, the camshaft 26 may include first and second shafts 34, 36, a first set of lobe members 38, 40, 42, 44, 46, a second set of lobe members 48, 50, 52, 54, and fasteners 56. In the present example, the first set of lobe members 38, 40, 42, 44, 46 may form an intake lobe set and the second set of lobe members 48, 50, 52, 54 may form an exhaust lobe set. However, it is understood that alternate arrangements may be provided where the first set of lobe members 38, 40, 42, 44, 46 may form an exhaust lobe set and the second set of lobe members 48, 50, 52, 54 may form an intake lobe set. Further, each of the first and second sets of lobe members 38, 40, 42, 44, 46, 48, 50, 52, 54 are not limited to only intake or exhaust valves. For example, the first and second sets of lobe members 38, 40, 42, 44, 46, 48, 50, 52, 54 may each include an intake lobe and/or an exhaust lobe. The first shaft 34 may be fixed for rotation with a first phaser member 58 and the second shaft 36 may be fixed for rotation with a second phaser member 60. The first and second phaser members 58, 60 may be rotatable relative to one another and relative to a rotationally driven member 62 of the phaser 28.

The first shaft 34 may include an annular wall 64 defining an inner bore 66. The second shaft 36 may be rotatably disposed within the inner bore 66 of the first shaft 34. The first shaft 34 may include slots 68 (seen in FIGS. 4 and 5) therethrough and the second shaft 36 may include apertures 70 that receive the fasteners 56 therein and couple the second set of lobe members 48, 50, 52, 54 for rotation with the second shaft 36. The slots 68 may form radial bores through the first shaft 34 and the apertures 70 may form radial bores through the second shaft 36. The slots 68 in the first shaft 34 may generally allow for a rotational travel of the fasteners 56 therein.

The first set of lobe members 38, 40, 42, 44, 46 may be fixed for rotation with the first shaft 34. The engagement between the first set of lobe members 38, 40, 42, 44, 46 and the first shaft 34 may include a friction fit engagement. The second set of lobe members 48, 50, 52, 54 may be disposed between adjacent ones of the first set of lobe members 38, 40, 42, 44, 46. The second set of lobe members 48, 50, 52, 54 may be rotatably disposed on the first shaft 34 and fixed for rotation with the second shaft 36 by the fasteners 56.

Figure 4:
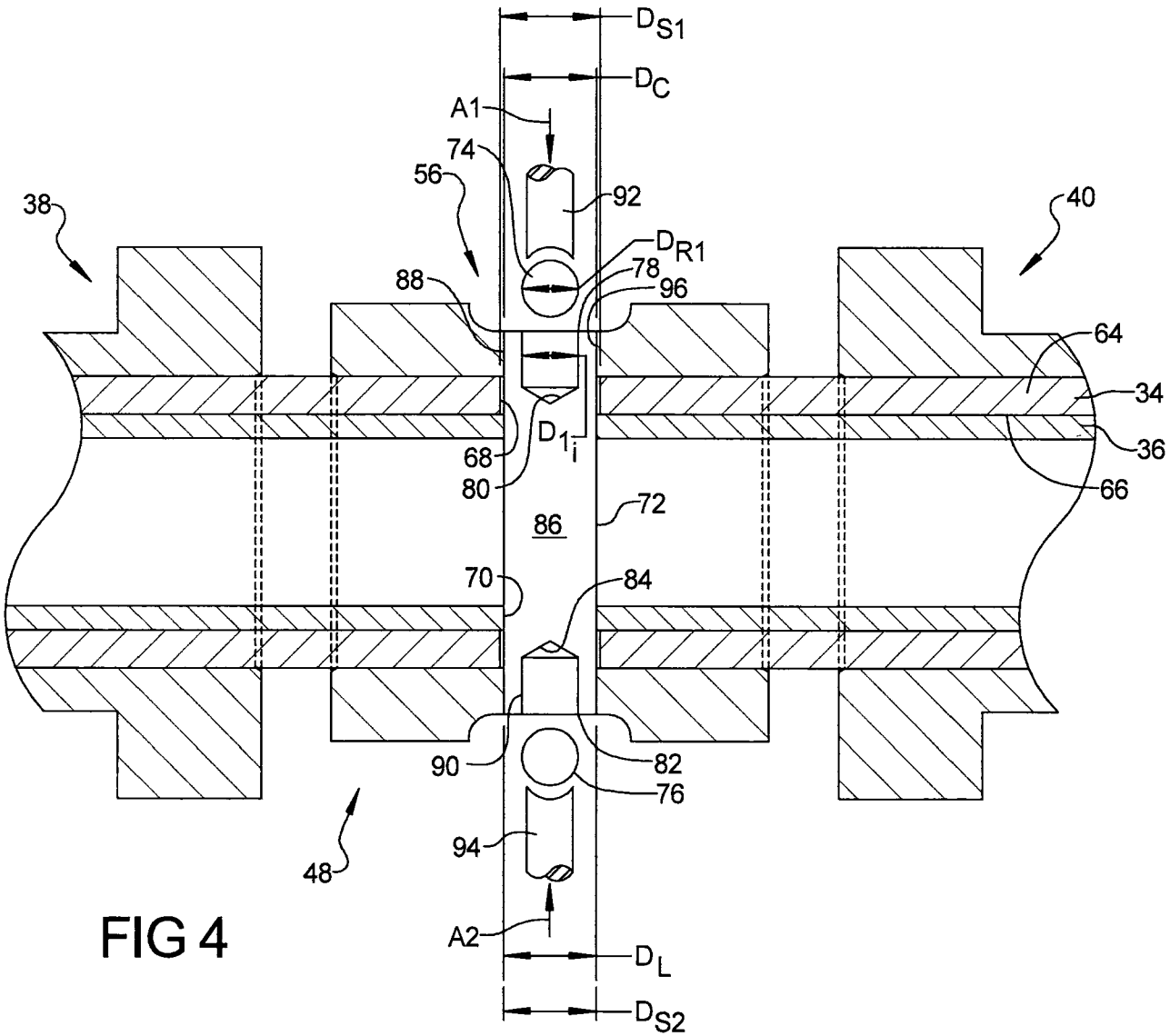
FIG. 4 is a fragmentary section view of a camshaft and a tool assembly according to the present disclosure.
Figure 5:
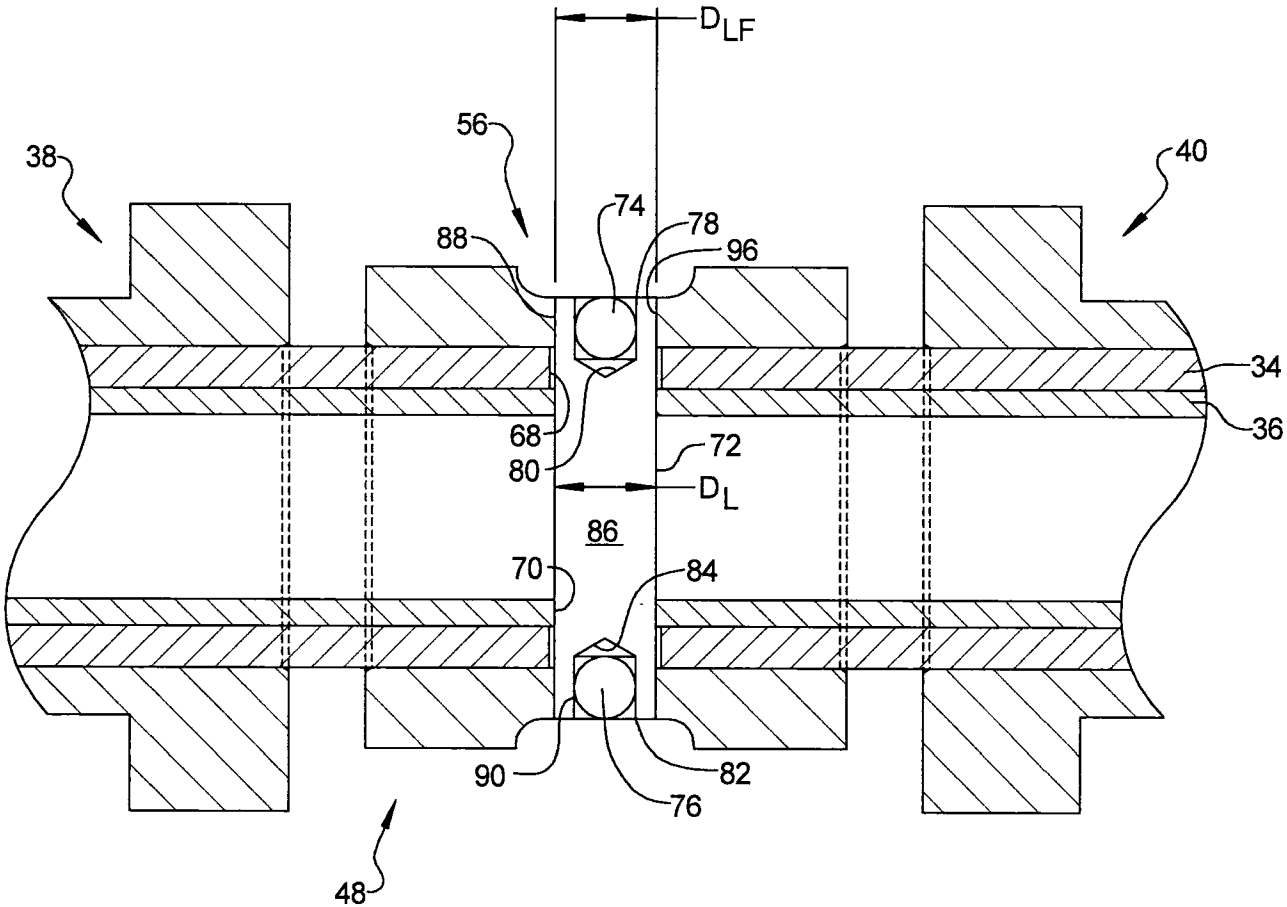
FIG. 5 is a fragmentary section view of the camshaft according to the present disclosure.

As seen in FIGS. 4 and 5, the fasteners 56 may each include a locking pin 72 and first and second retaining members 74, 76. The locking pin 72 may include a first end 78 having a first recess 80 and a second end 82 generally opposite the first end 78 having a second recess 84. The first and second recesses 80, 84 may extend axially toward one another and may be separated by a generally solid medial portion 86 of the locking pin 72. The first recess 80 may define a first annular wall 88 at the first end 78 and the second recess 84 may define a second annular wall 90 at the second end 82.

The first retaining member 74 may be located in the first recess 80 and the second retaining member 76 may be located in the second recess 84. The first and second retaining members 74, 76 may fix the locking pin 72 to one of the lobe members 48, 50, 52, 54. By way of non-limiting example, each of the first and second retaining members 74, 76 may be in the form of a generally spherical member.

First and second tools 92, 94 may be used to fix the first and second retaining members 74, 76 within the first and second recesses 80, 84. The locking pin 72 may have an outer diameter ($D_L$) that is less than the diameter ($D_C$) of the bore 96 extending through the lobe member 48, less than the width ($D_{S1}$) of the slot 68 in the first shaft 34, and less than the diameter ($D_{S2}$) of the aperture 70 in the second shaft 36. Therefore, the locking pin 72 may be placed within the bore 96, the slot 68, and the aperture 70 with little frictional resistance.

The first tool 92 may force the first retaining member 74 in a first axial direction (Al) into the first recess 80. An end of the first recess 78 may form an axial end stop for the first retaining member 74. As seen in FIG. 4, the first recess 80 may have an initial diameter ($D_{1i}$) that is less than the diameter ($D_{R1}$) of the first retaining member 74. Therefore, when the first retaining member 74 is forced into the first recess 80, the first annular wall 88 is deformed in an outward radial direction and into a frictional engagement with a first portion of the bore 96 in the lobe member 48, as seen in FIG. 5. The first annular wall 88 may be deformed to a final outer diameter ($D_{Lf}$) that is greater than the outer diameter ($D_L$) of the remainder of the locking pin 72 in order to provide the frictional engagement with the lobe member 48. The first retaining member 74 may be retained within the first recess 84 after being forced into the first recess 74 by the first tool 92.

Similarly, the second tool 94 may force the second retaining member 76 into the second recess 84. It is understood that the relationship between the second retaining member 76 and the second recess 84 may be generally similar to the first retaining member 74 and the first recess 78 described above. However, the second retaining member 76 may be displaced in a second axial direction (A2) generally opposite the first axial direction (A1).

The frictional engagement created by the displacement of the first and second retaining members 74, 76 may generate forces on the camshaft 26 during assembly. More specifically, the installation of the first retaining member 74 may generate a first force (F1) in the first axial direction (A1) and the installation of the second retaining member 76 may generate a second force (F2) in the second axial direction (A2). The first and second forces (F1, F2) may be applied in axial directions (A1, A2) relative to the locking pin 72 and in radial directions relative to the first and second shafts 34, 36. Further, the first and second forces (F1, F2) may be equal to one another in opposite directions, producing a net force of approximately zero. Therefore, the first and second retaining members 74, 76 may be installed in the locking pin 72 simultaneously to reduce a bending force applied to the first and second shafts 34, 36.

It is understood that the fastener 56 is shown in combination with the lobe member 48 in FIGS. 4 and 5 for simplicity and the description applies equally to the remainder of the second set of lobe members 50, 52, 54.

What is claimed is:

1. A method of assembling a camshaft assembly comprising:

locating a first lobe member of the camshaft assembly on a first shaft of the camshaft assembly;

inserting a locking pin into a first bore in the first lobe member and a second bore of the first shaft, the locking pin having a first closed ended recess extending into a first end thereof defining an annular wall surrounding said closed ended recess; and forcing a first retaining member into the first closed ended recess, the forcing displacing the annular wall in an outward radial direction and into a frictional engagement with the first bore.

2. The method of claim 1, further comprising forcing a second retaining member into a second closed ended recess located in a second end of the locking pin generally opposite the first end.

3. The method of claim 2, wherein the forcing the first and second retaining members are performed simultaneously.

4. The method of claim 3, wherein the forcing the first retaining member applies a first radial force on the camshaft assembly and the forcing the second retaining member applies a second radial force on the camshaft assembly, the second radial force being approximately equal to and opposite the first radial force.

5. The method of claim 2, wherein the locking pin includes a generally solid region located axially between the first and second closed ended recesses.

6. The method of claim 1, wherein the first retaining member is retained within the first closed ended recess after the forcing.

7. The method of claim 1, wherein the first retaining member includes a generally spherical member.

8. The method of claim 1, wherein the forcing displaces the annular wall into engagement with the second bore.

9. The method of claim 1, wherein the camshaft assembly includes a second shaft, the first shaft defining an axial bore and the second shaft being located within the axial bore, the first lobe member being rotatably disposed on an outer radial surface of the first shaft and fixed for rotation with the second shaft through an engagement between the locking pin and the second shaft.

10. The method of claim 1, wherein an inner diameter of the first closed ended recess is less than a diameter of the first retaining member before the forcing.

11. The method of claim 1, wherein an end of the first closed ended recess forms an axial end stop for the first retaining member.

12. A method of assembling a camshaft assembly comprising:

locating a first lobe member of the camshaft assembly on a first shaft of the camshaft assembly;

inserting a locking pin into a first bore in the first lobe member and a second bore of the first shaft, the locking pin having a first closed ended recess extending into a first end thereof and a second closed ended recess extending into a second end thereof generally opposite the first end;

forcing a first retaining member in a first direction into the first closed ended recess, the forcing displacing a first annular wall defined by the first closed ended recess in an outward radial direction and into a frictional engagement with a first portion of the first bore; and forcing a second retaining member, separate from the first retaining member, in a second direction generally opposite the first direction and into the second closed ended recess, the forcing displacing a second annular wall defined by the second closed ended recess in an outward radial direction and into a frictional engagement with a second portion of the first bore.

13. The method of claim 12, wherein the forcing the first retaining member and the forcing the second retaining member are performed simultaneously, the forcing the first retaining member applying a first force in the first direction and the forcing the second retaining member applying a second force in the second direction generally equal to the first force.

14. A camshaft assembly comprising:

a first shaft including a first radial bore;

a first lobe member located on the first shaft and including a second radial bore aligned with the first radial bore; and a fastener including a locking pin and a first retaining member, the locking pin located within the first and second radial bores and including first and second longitudinal ends generally opposite one another, the first longitudinal end having a first closed ended recess extending axially therein, the first retaining member located within the first closed ended recess and biasing an annular wall defined by the first closed ended recess in an outward radial direction into a frictional engagement with a first portion of the second radial bore.

15. The camshaft assembly of claim 14, further comprising a second shaft, the first shaft including a first axial bore and the second shaft being located within the first axial bore and including a third radial bore aligned with the first and second radial bores and receiving the locking pin therein, the first lobe member being rotatably disposed on the first shaft and being fixed for rotation with the second shaft through an engagement with the locking pin.

16. The camshaft assembly of claim 14, wherein the locking pin includes a generally solid region between the first recess and the second longitudinal end of the locking pin.

17. The camshaft assembly of claim 14, wherein the second longitudinal end of the locking pin includes a second recess extending axially therein, the fastener including a second retaining member located within the second recess and biasing an annular wall defined by the second recess into a frictional engagement with a second portion of the second radial bore.

18. The camshaft assembly of claim 17, wherein the first and second portions of the second radial bore are located approximately 180 degrees from one another.

19. The camshaft assembly of claim 14, wherein the locking pin includes a generally solid region axially between the first and second recesses.

20. The camshaft assembly of claim 14, wherein the first retaining member includes a generally spherical member.

* * * * *